US005226600A

United States Patent [19]

Frank

[11] Patent Number: 5,226,600

[45] Date of Patent: Jul. 13, 1993

[54] CHECK VALVE

[75] Inventor: Peter L. Frank, Hamel, Minn.

[73] Assignee: Wagner Spray Tech Corporation, Minneapolis, Minn.

[21] Appl. No.: 740,470

[22] Filed: Aug. 2, 1991

[51] Int. Cl.[5] ..... B05B 7/24

[52] U.S. Cl. ..... 239/337; 239/346; 239/367; 239/372; 137/854; 251/143; 285/239; 222/464

[58] Field of Search ..... 239/373, 337, 327, 372, 239/340, 346, 302, 367; 222/481, 481.5, 211, 382, 464; 137/852, 854; 251/143, 146; 285/328, 332, 9.2, 239

[56] References Cited

U.S. PATENT DOCUMENTS

| | | | |
|---|---|---|---|
| 489,786 | 1/1893 | Bonbrake | 222/464 |
| 1,166,059 | 12/1915 | Ledbetter | 285/239 |
| 2,005,776 | 6/1935 | Downs | 239/367 |
| 2,052,362 | 8/1936 | Roselund . | |
| 2,079,933 | 5/1937 | Fisher | 239/367 |
| 2,602,004 | 7/1952 | Faktor . | |
| 2,670,882 | 3/1954 | Best | 222/464 |
| 2,904,262 | 9/1959 | Peeps | 239/346 |
| 2,951,645 | 9/1960 | Price et al. | 239/337 |
| 2,987,226 | 6/1961 | Bane | 222/464 |
| 3,401,842 | 9/1968 | Morrison | 222/181 |
| 3,685,739 | 8/1972 | Vanier | 239/333 |
| 3,732,734 | 5/1973 | Avakian | 285/239 |
| 3,796,376 | 3/1974 | Farnsteiner | 239/528 |
| 3,990,609 | 11/1976 | Grant | 239/121 |
| 4,147,306 | 4/1979 | Bennett | 239/372 |
| 4,566,722 | 1/1986 | Huber et al. | 285/332 |
| 4,615,467 | 10/1986 | Grogan et al. | 222/211 |
| 4,760,962 | 8/1988 | Wheeler | 239/346 |
| 4,936,490 | 6/1990 | Battegazzore | 222/211 |
| 5,015,014 | 5/1991 | Sweeny | 285/328 |

FOREIGN PATENT DOCUMENTS

| | | | |
|---|---|---|---|
| 2637790 | 3/1978 | Fed. Rep. of Germany | 137/854 |
| 1183786 | 7/1959 | France | 137/854 |
| 1325479 | 3/1963 | France | 239/367 |

*Primary Examiner*—Kevin P. Shaver
*Assistant Examiner*—Christopher G. Trainor
*Attorney, Agent, or Firm*—Faegre & Benson

[57] ABSTRACT

An improved check valve for portable paint cup spray guns having a radially extending concave diaphragm surrounding a syphon tube and forming a seal with an interior surface of a lid of the paint cup.

8 Claims, 2 Drawing Sheets

CHECK VALVE

BACKGROUND OF THE INVENTION

This invention relates to high volume low pressure or HVLP paint spray guns having a paint cup and utilizing a syphon tube to draw the paint from the paint cup and deliver it to the gun. In such guns it has been desirable to provide a passage for air to enter the paint cup to prevent the creation of a vacuum which would resist or prevent paint from being drawn up the suction tube. Such an air passage, if unprotected, can easily be clogged with paint, particularly when the gun is used to paint horizontal surfaces. This need has led to a number of designs for check valves and other structures for paint cup spray guns, all of which attempt to both permit air to enter the paint cup and prevent paint from exiting the paint cup at that point. Conventional check valves and other designs attempting to address this problem have been costly, complicated, difficult to clean and often have imperfect operation.

The present invention overcomes deficiencies of the prior art by providing a simple, low cost and easily cleanable check valve which both admits air to the paint cup to prevent creation of a vacuum and prevents egress of paint or other liquid from the paint cup through the air venting path.

DETAILED DESCRIPTION

Figure 2:
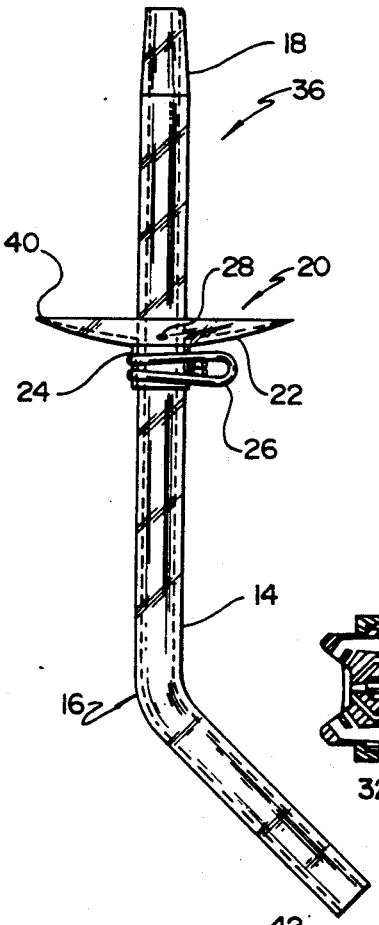
FIG. 2 is a side elevation view of a syphon tube and check valve diaphragm assembly useful in the practice of the present invention.
Figure 1:
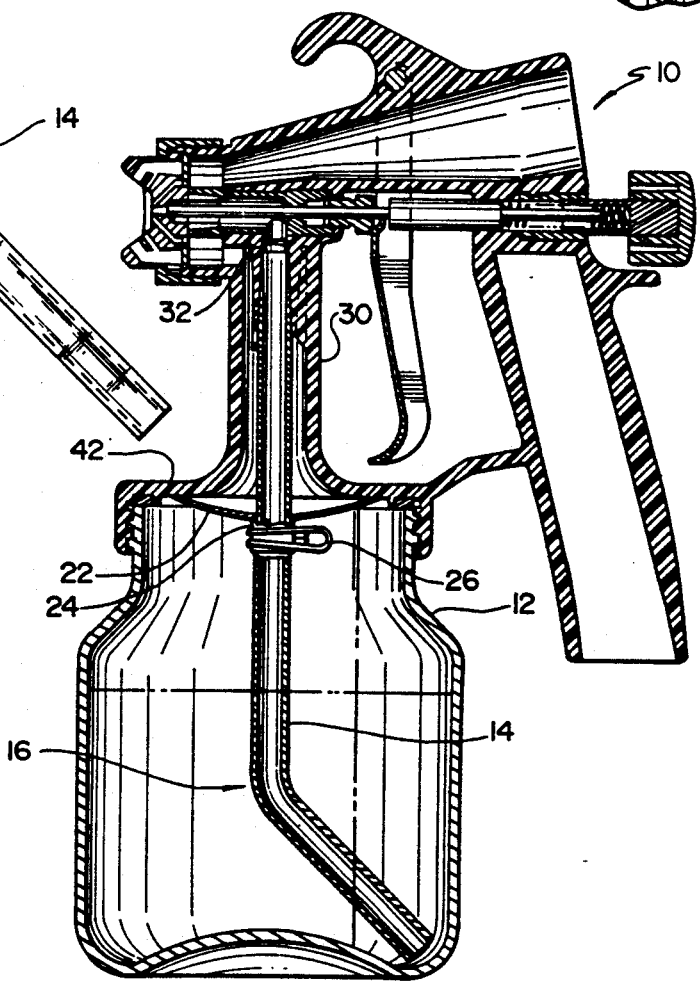
FIG. 1 is a side elevation view of a paint gun assembly showing the present invention.
Figure 4:
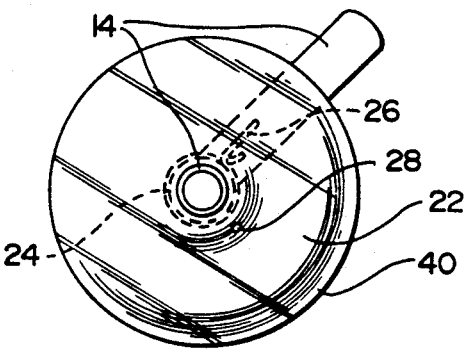
FIG. 4 is a top view of the syphon tube and check valve diaphragm of the present invention.
Figure 5:
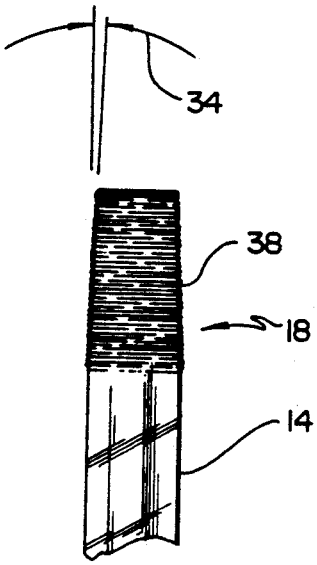
FIG. 5 is a fragmentary detail view of the tapered tip of the syphon tube of the present invention.

Referring now to FIG. 1, a paint gun assembly 10 may be seen. Gun 10 preferably has a paint cup 12 from which paint is drawn by a syphon tube 14. Referring now also to FIGS. 2, 4 and 5 tube 14 is preferably 0.375" in diameter, formed of nylon and manufactured by heat forming an angle 16 partially along tube 14 and further by machining a taper having a taper angle 34 of 1° 40'±0° 15' at a proximal or first end 18 of tube 14. It is to be understood that taper 18 has a relatively coarse machine finish as indicated in FIG. 5. Siphon tube 14 preferably carries a diaphragm 20 formed of low density polyethylene and having a relatively wide flange portion 22 preferably having a 2.4" diameter carried by an integral collar or hub 24. Diaphragm 20 preferably is 0.050" thick at hub 24. Hub 24 is preferably secured to tube 14 by a wire spring clip 26. In one embodiment, flange 22 preferably has an aperture 28 drilled through it in an eccentric location. Hole 28 is preferably 0.031"±0.004" in diameter. It has been found that using this diameter for aperture 28 prevents egress of liquid from the interior of paint cup 12 through aperture 28.

In an alternative embodiment, hole 28 may be omitted from flange 22.

Figure 3:
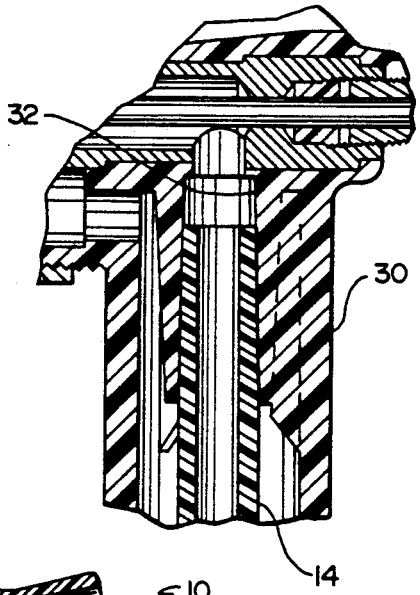
FIG. 3 is a fragmentary side detail view of a portion of the spray gun FIG. 1.

Referring now more particularly to FIGS. 3 and 5, paint gun 10 has a neck 30 having a tapered socket 32 molded therein. Socket 32 preferably has a taper angle equal to the taper angle of tube 14. This angle forms a "self-locking" taper such as may be achieved with taper angles of approximately 4° or less.

It is to be understood that assembly 36, made up of syphon tube 14, diaphragm 20, and clip 26, is retained in gun 10 by the interaction of the tapered socket 32 frictionally engaging tapered tip 18 as shown in FIG. 3.

Referring now again more particularly to FIG. 5, tapered tip 18 is preferably formed by machining tube 14 which typically results in machining marks or grooves 38. The irregular surface formed by marks 38, although not necessary, is believed to aid in the retention and release characteristics between tip 18 and socket 32.

It is further to be understood that (as may be seen most clearly in FIG. 2) diaphragm 20 has a tapered cross section with the outer periphery 40 having a gradually reduced or "feathered" cross section. Such a cross section provides flexibility to the outer peripheral region 40 of diaphragm 20. Such flexibility assures a consistent seal between region 40 and lid 42.

Figure 6:
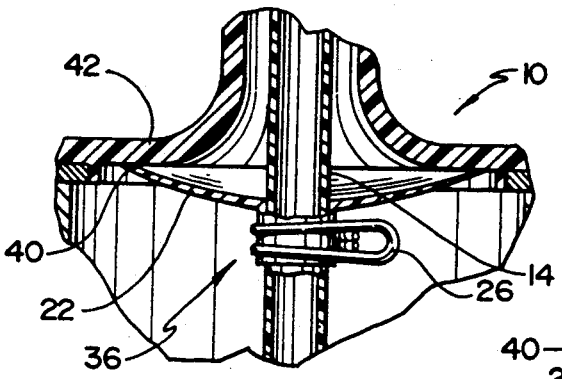
FIG. 6 is a fragmentary section view of a portion of FIG. 1 showing the syphon tube and check valve diaphragm in a position wherein the diaphragm is initially contacting the interior surface of the paint cup lid.
Figure 7:
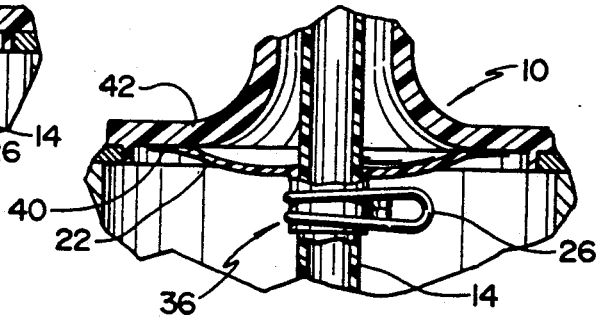
FIG. 7 is a view similar to FIG. 6, except with the check valve diaphragm fully engaging the paint cup lid.

Referring now to FIG. 6, as assembly 36 is inserted in gun 10, outer periphery 40 will initially contact lid 42. Assembly 36 is preferably inserted further into socket 32 resulting in diaphragm 20 deforming to the condition shown in FIG. 7 which shows assembly 36 fully installed in gun 10. In FIG. 7, Peripheral region 40 is either flat or slightly convex, while in FIG. 6 (and in FIG. 2) peripheral region 40 is on the concave curvature of diaphragm 20. As may be seen most clearly in FIG. 7, when assembly 36 is fully installed and seated against lid 42, a relatively wide seal is accomplished between region 40 and lid 42. This is illustrated graphically in FIG. 8 where region 40 is speckled to indicate the wide seal band or region that exists. Furthermore, this wide seal is at a relatively highly flexible region of diaphragm 20. In the embodiment not using aperture 28, the peripheral region 40 of diaphragm 20 will flex away from lid 42 to allow air to enter cup 12, but will reseal against lid 42 to prevent paint from leaking out of cup 12 via seal or region 40.

Figure 8:
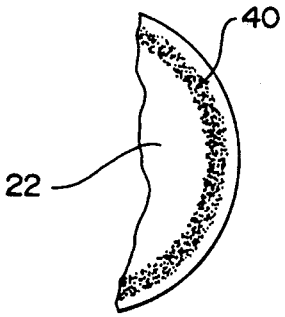
FIG. 8 is a fragmentary bottom view of the diaphragm of FIG. 4.

To assemble diaphragm 20 to tube 14, it has been found desirable to use a fixture in the following manner. First, tube 14 is manufactured and diaphragm 20 is installed on tube 14 relatively closer to bend or angle 16 than in the calibrated or final assembly position. Next the assembly of tube 14 and diaphragm 20 is inserted into socket 32 of gun 10. Next spring clip 26 is expanded to allow movement along tube 14, and a fixture is used to Position diaphragm 20 with respect to lid 42 to achieve the seal as shown in FIG. 8. Finally, clip 26 is released, thus clamping hub 24 and hence diaphragm 20 to tube 14, thus calibrating the position of diaphragm 20 with respect to tube 14 and the particular gun 10 with which it is to be used.

The invention is not to be taken as limited to all of the details thereof as modifications and variations thereof may be made without departing from the spirit or scope of the invention.

What is claimed is:

1. An apparatus for preventing the creation of a vacuum in a paint cup of a paint spray gun, comprising:

a. a syphon tube having a first end and a second end, adapted to pass through a lid of the paint cup, and having a tapered portion at the first end for frictional interengagement with a tapered receptacle portion in the paint spray gun such that the frictional interengagement between the tapered portion of the first end of the syphon tube and the tapered receptacle portion in the paint spray gun retains the syphon tube in the gun;

b. a flexible diaphragm located on the syphon tube, the diaphragm having:

i) a diameter substantially larger than the diameter of the syphon tube;

ii) a concave surface facing the first end of the syphon tube;

iii) a rim portion on the concave surface for sealing contact with an interior surface of the lid such that an area of the sealing contact increases radially as the first end is inserted into the tapered receptacle portion.

2. The apparatus of claim 1 further comprises a wire spring clip type fastening means for securing the diaphragm to the syphon tube.

3. The apparatus of claim 2 wherein the diaphragm further comprises a collar surrounding the syphon tube and the wire spring clip type fastening means surrounds the collar to secure the diaphragm to the syphon tube.

4. The apparatus of claim 1 herein the tapered portion of the first end of the syphon tube has relatively small circumferential grooves on the exterior surface thereof.

5. The apparatus of claim 1 wherein the second end is angled with respect to the first end of the syphon tube.

6. The apparatus of claim 1 wherein the diaphragm has an eccentrically located aperture therethrough having a diameter sufficiently small to prevent the passage of liquid through the diaphragm.

7. The apparatus of claim 1 wherein the cross-sectional thickness of the diaphragm decreases radially toward the rim such that a relatively wide seal is formed between a peripheral region of the diaphragm and the interior surface of the lid.

8. A method of positioning a diaphragm on a syphon tube, comprising the steps of:

a. sliding a diaphragm onto a syphon tube;

b. inserting the syphon tube into a paint spray gun having a paint cup lid;

c. moving the diaphragm along the syphon tube until the rim contacts an interior surface of the lid and a peripheral region of decreased cross-sectional thickness forms a relatively wide seal against an interior surface of the lid; and d. clamping the diaphragm to the syphon tube to prevent further movement of the diaphragm along the syphon tube.

* * * * *

UNITED STATES PATENT AND TRADEMARK OFFICE

CERTIFICATE OF CORRECTION

PATENT NO. : 5,226,600

DATED : July 13, 1993

INVENTOR(S) : Peter L. Frank

It is certified that error appears in the above-identified patent and that said Letters Patent is hereby corrected as shown below:

Column 4, Claim 4, Line 1, delete "herein" and insert -- wherein --.

Signed and Sealed this

Third Day of May, 1994

Bruce Lehman

*Attest:*

BRUCE LEHMAN

*Attesting Officer*

*Commissioner of Patents and Trademarks*